US010738547B2

(12) United States Patent
Sumrall

(10) Patent No.: US 10,738,547 B2
(45) Date of Patent: Aug. 11, 2020

(54) BOREHOLE CONDITIONING TOOLS

(71) Applicant: Ernest Newton Sumrall, Huntsville, TX (US)

(72) Inventor: Ernest Newton Sumrall, Huntsville, TX (US)

( * ) Notice: Subject to any disclaimer, the term of this patent is extended or adjusted under 35 U.S.C. 154(b) by 0 days.

(21) Appl. No.: 16/458,730

(22) Filed: Jul. 1, 2019

(65) Prior Publication Data

US 2019/0323302 A1 Oct. 24, 2019

Related U.S. Application Data

(62) Division of application No. 15/536,179, filed as application No. PCT/US2015/066065 on Dec. 16, 2015, now Pat. No. 10,337,266.

(Continued)

(51) Int. Cl.

| | |
|---|---|
| ***E21B 41/00*** | (2006.01) |
| ***E21B 17/10*** | (2006.01) |
| ***E21B 21/00*** | (2006.01) |
| ***E21B 17/00*** | (2006.01) |
| ***E21B 10/26*** | (2006.01) |
| *E21B 7/04* | (2006.01) |

(52) U.S. Cl.

CPC ..... *E21B 21/00* (2013.01); *E21B 10/26* (2013.01); *E21B 17/00* (2013.01); *E21B 17/1078* (2013.01); *E21B 41/00* (2013.01); *E21B 7/04* (2013.01)

(58) Field of Classification Search

None

See application file for complete search history.

(56) References Cited

U.S. PATENT DOCUMENTS

| | | | |
|---|---|---|---|
| 2,884,074 | A | 4/1959 | Bobo et al. |
| 3,423,052 | A | 1/1969 | Lear |

(Continued)

FOREIGN PATENT DOCUMENTS

| | | | |
|---|---|---|---|
| EP | 0188343 | A2 | 7/1986 |
| GB | 2061358 | A | 5/1981 |

(Continued)

OTHER PUBLICATIONS

International Search Report for PCT/US2015/066065 dated Jun. 2, 2016 (2 pages).

(Continued)

*Primary Examiner* — Shane Bomar

(74) *Attorney, Agent, or Firm* — Fitch, Even, Tabin & Flannery, LLP

(57) ABSTRACT

A borehole tool, having a cylindrical body, the cylindrical body having an upper shank, a lower shank, and a component tool disposed between the upper shank and the lower shank, wherein the tool is configured to have an outer surface airfoil configuration, whereby lift is created as fluid passes along the cylindrical body. The component tool can be a combination stabilizer tool, a reamer tool and a cutting removal tool, wherein the stabilizer tool is configured as a helical stabilizing blade and reamer blade, a flow path disposed between the helices of the stabilizing and reamer blade, the stabilizing and reamer blade further comprising a reamer cutting element disposed where an edge of the stabilizing and reamer blade meets the flow path.

8 Claims, 11 Drawing Sheets

Related U.S. Application Data

(60) Provisional application No. 62/092,652, filed on Dec. 16, 2014.

(56) References Cited

U.S. PATENT DOCUMENTS

| | | | | |
|---|---|---|---|---|
| 4,492,277 | A | 1/1985 | Creighton | |
| 5,341,888 | A | 8/1994 | Deschutter | |
| 5,794,725 | A | 8/1998 | Trujillo et al. | |
| 6,302,223 | B1 | 10/2001 | Sinor | |
| 8,905,162 | B2 | 12/2014 | Torres | |
| 2006/0090936 | A1 | 5/2006 | Nataneal et al. | |
| 2012/0255724 | A1 | 10/2012 | Hallunbaek et al. | |
| 2014/0338438 | A1 | 11/2014 | Fripp et al. | |
| 2016/0177636 | A1 | 6/2016 | Greci et al. | |
| 2016/0177637 | A1* | 6/2016 | Fleckenstein | E21B 33/14 166/285 |
| 2017/0002634 | A1 | 1/2017 | Casey | |
| 2017/0044868 | A1 | 2/2017 | Van Petegem et al. | |
| 2018/0087329 | A1 | 3/2018 | Chen | |

FOREIGN PATENT DOCUMENTS

| | | | |
|---|---|---|---|
| SU | 966223 | A1 | 10/1982 |
| WO | 9109202 | A1 | 6/1991 |

OTHER PUBLICATIONS

Written Opinion of the International Searching Authority dated Jun. 2, 2016 (3 pages).

* cited by examiner

BOREHOLE CONDITIONING TOOLS

CROSS-REFERENCE TO RELATED APPLICATIONS

This application is a Divisional of U.S. application Ser. No. 15/536,179 filed Jun. 15, 2017, which is a U.S. national phase application filed under 35 U.S.C. § 371 of International Application No. PCT/US2015/066065, filed Dec. 16, 2015, designating the United States, which claims the benefit of U.S. Provisional Application No. 62/092,652, filed Dec. 16, 2014, entitled BOREHOLE CONDITIONING FLUID PULSE SUB for Ernest Newton Sumrall, which are hereby incorporated by reference in their entirety for all purposes.

FIELD

Drill string stabilizers, subs and other borehole tools typically used in earth boring operations, and in particular downhole tools configured with a cambered airfoil, which reduces drilling drag and friction, improves cuttings transport and improves borehole quality.

BACKGROUND

A drill string is a drill pipe that transmits drilling fluid and torque to a drill bit. It can also be associated to an assembly of components such as drill pipe, drill collars, tools, drill bits and the like. Drill string "subs" can refer to the individual tools that perform specific functions when incorporated into a drill string. There are many types of subs, including crossover subs used to change thread types and male/female connection positioning; stabilizer subs used to centralize the drill string during drilling; vibrating subs to reduce the incidence of sticking by maintaining motion in the drill string, and the like.

Typically stabilizers, conditioning subs, vibrating subs and reamers of many types are constructed with one or more ribs, blades, ridges or other features, which protrude from the main body of the sub. These ridges, blades or other protuberances may or may not contain cutters to remove ridges or other irregularities in the borehole. They may also contain additional fluid passages and wear elements to maintain the predetermined diameter as manufactured when the sub is rotating or being pulled out of the borehole or run into the borehole.

Specifically, stabilizers known in the art usually have a plurality of blades which run axially and engage the borehole wall at gage (e.g., at the true diameter of the hole) or near gage. (e.g., close to but not quite as large as the diameter of the hole). Current stabilizers can be straight bladed, can have helix (meaning the blades are spiraled) or can be composed of a plurality of bumps or small surfaces that are configured to contact the borehole wall. FIG. 14 shows a traditional stabilizer, or if the blades had cutting or abrasion elements a traditional reamer as it would look in the hole. Specifically, FIGS. 14 and 16 illustrate a known stabilizer tool 110 having helix blades 102 within hole 114. Stabilizer tool 110 has a threaded pipe connection 116 having external threads 118 at the lead end and internal threads at the trailing end to match external threads 118 of other drill string components.

Known reamers can be fixed (e.g., they are preset at a given diameter) or they can expand to a predetermined diameter. Typical cutting structures for reamers gradually engage the borehole through a gradual expansion of the outside diameter (OD) of the cutters in an arc on the profile of the blade or engagement surface. Reamer apparatuses are usually used for enlarging the borehole or for smoothing out the borehole while drilling oil, gas, water, or geothermal wells. FIG. 17 illustrates a known reamer tool 120 having cutting structures 122.

Known cuttings removal tools, such as shown at 100 in FIGS. 15 and 18, usually have "blades" or "scoops" 102 that pick up cuttings (i.e., the chips of removed rock and the like) which have settled out on the bottom of the long lateral or horizontal sections of a hole 104. A fluid and materials flow path 106 assists in materials removal. The blades work through the rotation of the drill string. Cuttings removal tools are usually used to assist in the drilling of oil, gas, water, or geothermal wells, especially in the long lateral or horizontal wells Each known types of subs, when employed in Extended Reach Drilling (ERD) applications, produces a restriction to drilled cuttings carried in the circulating fluid by virtue of their protuberances, being oversize relative to the nominal drill string diameter. In many ERD wells, the limits of the drill string, rig pumps, fluid carrying capacity and additional technical limitations are strained. Equipment and physical design limitations are approached on a regular basis.

As ERD wells are, by their nature, non-vertical, there are ledges and ridges created in the drilled surfaces as the borehole is steered in one direction or another. Each time the drilling system is switched from sliding directionally using only mud motor RPM to drilling ahead and rotating the entire string, there is a change in borehole drilled diameter. The concatenation (i.e., a series of interconnected or events) of these changes increases borehole rugosity and overall friction that reduces efficiencies of the drill bit, the motor torque and both the axial and torsional movement of the drill string during operations.

Additionally, as wellbores lengthen, the ability of the fluid to move cuttings from the wellbore to the surface declines, this movement being a function of the pump output, mud properties, temperature, borehole rugosity and the like. Typically, gravity pulls the drill string to the lower boundary of the wellbore, which forces a larger volume of the fluid into the larger annular area created with the drill string on the bottom of the wellbore. Cuttings thus tend to build up along the bottom of non-vertical wellbores, decreasing drilling efficiency by increasing torque values (both axial and torsional). This increase in torque increases the required Mechanical Specific Energy (MSE), which is defined as the amount of energy required to fail (e.g., cut through) a unit volume of rock.

Irregular borehole surfaces (rugosity) in the curve section of a wellbore (portion of the wellbore where the departure from vertical is initiated) and accumulation of cuttings in the lateral (the portion of the well where the angle approaches horizontal or more) have a well defined, detrimental effect on drilling efficiency, requiring an increase in MSE to successfully drill to the desired borehole length.

Thus the nature of ERD wells is that they typically reach or approach the limits of mechanical rig operational capacities, mud properties and downhole tool abilities. Any tool or item that serves to increase efficiencies downhole will reduce the MSE required and improve the outcome of the well being drilled as planned. Accumulation of drilled cuttings on the lower circumference of the borehole reduces efficiencies in many ways, and raises required MSE needed to drill ahead.

In ERD wells, adding additional fluid openings reduces volume at the bottom (bit exit) of the drill string unless the pump output is increased to compensate; it is a closed system with finite input. When the input limits are approached or reached in typical ERD wells, adding any hydraulic opening away from the drill bit reduces the fluid velocity, and thus reduces cleaning and carrying capacity of the drilling mud throughout the wellbore. It is thus counterproductive to add additional fluidic enhancement elements in most ERD wells without concomitantly increasing fluid volume. This precludes pulsing or hydraulically driven vibrating subs, which become more problematic in operation as the wellbore lengthens and the available hydraulic energy declines.

SUMMARY

Described herein are borehole conditioning tools such as drill string stabilizers, subs and other downhole tools typically used in drill string earth boring operations, and in particular borehole tools configured with a cambered airfoil, which reduces drilling drag and friction, improves cuttings transport and improves borehole quality.

Some embodiments provide borehole tool, having a cylindrical body, the cylindrical body having an upper shank, a lower shank, and a component tool disposed between the upper shank and the lower shank, wherein the tool is configured to have an outer surface airfoil configuration, whereby lift is created as fluid passes along the cylindrical body.

According to one approach, the component tool is selected from the group consisting of a stabilizer tool, a reamer tool and a cutting removal tool.

According to one approach, the component tool can be a combination stabilizer tool, a reamer tool and a cutting removal tool, wherein the stabilizer tool is configured as a helical stabilizing blade and reamer blade, a flow path disposed between the helices of the stabilizing and reamer blade, the stabilizing and reamer blade further comprising a reamer cutting element disposed where an edge of the stabilizing and reamer blade meets the flow path.

According to one approach, a designed tubular surface is provided where fluid moving across said tubular surface enters an annular cross sectional area that is reduced in the axial direction at a predetermined rate, based upon the commonly known principles of the cambered airfoil.

According to another approach, a tubular surface design is provided having a configuration allowing change in annular volume based upon the traditional cambered airfoil mathematics, which is bi-directional rather than uni-directional as the cambered airfoil; said surface configured to generate differing fluid velocities irrespective of fluid motion being upwards, towards the surface or down, towards the end of the wellbore, of a drill string axis.

According to another approach the tubular surface can have the orientation of the reduced cross section functions with fluid movement towards the surface of a wellbore.

According to another approach the tubular surface design can have the orientation of the reduced cross section functions with fluid movement towards the bottom of a wellbore.

According to another approach the tubular surface design can have the cambered airfoil feature disposed on drill pipe tubulars.

According to another approach the tubular surface design can have the cambered airfoil feature disposed on a drill collar.

According to another approach the tubular surface design can have the cambered airfoil feature disposed on a downhole motor housing, measurement while drilling tool housing or logging while drilling tool housing.

According to another approach the tubular surface design can have the cambered airfoil feature disposed on a hole opener, under-reamer or similar earth removal tool body.

According to another approach the tubular design can have the cambered airfoil feature disposed on a stabilizer or hole-conditioning tool.

According to another approach the cambered airfoil feature can be disposed on a crossover sub, pulsing sub, dampening sub, drilling jars or other downhole tool body or combinations thereof.

According to another approach the tubular surface design can have the cambered airfoil feature disposed on drill pipe tubulars.

According to another approach the tubular surface design can have the cambered airfoil feature disposed on a drill collar.

According to another approach the tubular surface design can have the cambered airfoil feature disposed on a downhole motor housing, measurement while drilling tool housing or logging while drilling tool housing.

According to another approach the tubular surface design can have the cambered airfoil feature disposed on a hole opener, under-reamer or similar earth removal tool body.

According to another approach the tubular design surface can have the cambered airfoil feature disposed on a stabilizer or hole-conditioning tool.

According to another approach the tubular surface can have the cambered airfoil feature disposed on a crossover sub, pulsing sub, dampening sub, drilling jars or other downhole tool body or combinations thereof.

According to another approach the tubular surface design can have the cambered airfoil feature disposed adjacent to the bi-directional tubular surface.

DESCRIPTION

Figure 1:
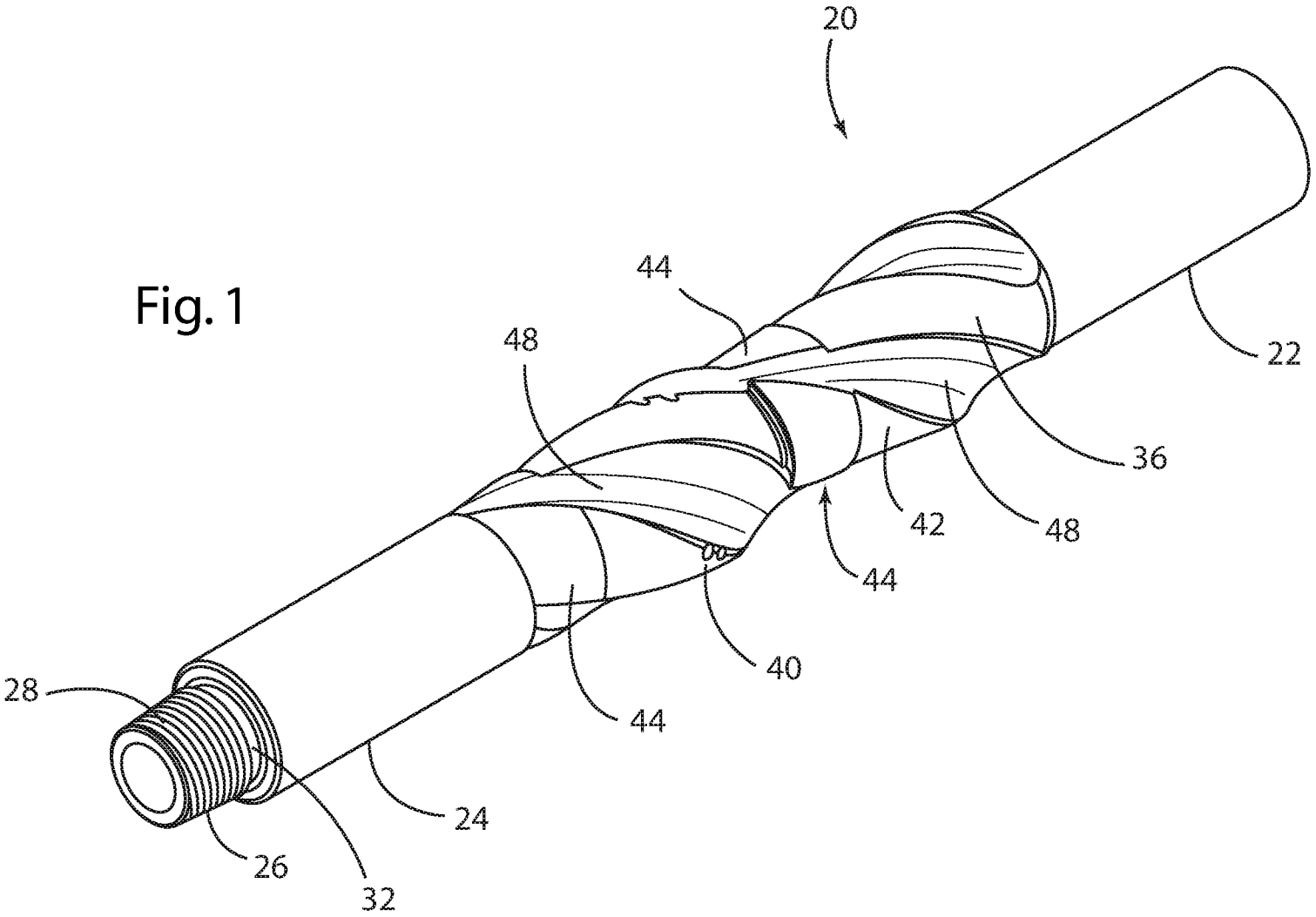
FIG. 1 illustrates a perspective view an exemplary stabilizing tool configured according to one approach of the present embodiments.

Extended Reach Drilling (ERD) projects are becoming more common in oilfield exploration. There are many advantages to ERD projects and many challenges are experienced while drilling. While building the curve in a well, ledges or rough borehole sections can and many times are created while transitioning between sliding and rotating. The presence of these transitions in the "dogleg" can and many times does reduce the efficiency of the transfer of weight and rotational energy through the borehole assembly (BHA).

Another challenge of ERD projects is experienced when the drill cuttings flowing through long lateral borehole sections begin to settle out of the flow and settle on the bottom of the borehole. The drill string typically sits on the bottom of the lateral section which forces the higher velocity flow to the upper segment of the lateral borehole. If and when these cuttings build up along the bottom of the lateral section, efficiency is affected by increasing the amount of energy required to fail a unit volume of rock. Mechanical specific energy (MSE) is, by definition, the amount of energy required to fail a unit volume of rock and is an indicator of the success of the application of resources to drilling the well. Increased friction caused by irregular surfaces in the curve and an accumulation of cuttings in the lateral can and many times does affect drilling efficiency and ultimately the cost of drilling and well also adding to a delay in production.

As mentioned above, in the normal course of drilling oil, gas, water, and/or geothermal wells certain challenges are faced. As the hole is drilled, drilling fluid- or MUD- is pumped down the center of the pipe from the surface. The mud travels all the way down the center of the pipe and flows primarily out the end of the pipe where the drill bit is located. The fluid exits the drill bit and begins the trip all the way back up the hole. As the mud exits the bit, it performs a number of functions. It cools the cutters of the bit and lifts and carries rock fragments created during drilling up the hole to the surface.

As the cuttings are carried up the borehole to the surface the loss of velocity, or the angle of the travel can cause some of the cuttings to settle down in the bottom of the hole. As cuttings settle down in the bottom of the hole they create "dunes" in the pipe-especially in the lateral, or near horizontal sections of the pipe. These dunes can affect the efficiency of the drilling operation by increasing torque and drag on the drill string. In other words, as the drill string slides along the hole, the dunes can impede movement which causes the driller to have to apply more weight to the bit. In the oilfield this is typically referred to as WOB, or "weight on bit" when describing the conditions required to drill a hole. The drill string can be as long as 15 to 20 thousand feet by the time the well is getting close to its end point. Putting more weight on the bit, means applying more force to the drill string at the surface. When more force, or WOB, is applied at the surface, the torque necessarily increases for several reasons. As the weight is increased, the steel pipe begins to buckle over the many thousands of linear feet which causes it to touch the borehole wall with more force and in more places as the string is rotating. Greater magnitudes of torque will more quickly cause the failure of tools that are used in the drill string.

To mitigate the appearance of cuttings dunes, many different methods can be employed. The properties of the MUD or drilling fluid can be also altered such that the cuttings stay in solution longer. Mechanical tools are designed and employed that force the cuttings back up into the flow path of the MUD. Processes are altered in order to clean the hold more often to prevent the gathering of this cuttings dunes. Additives are put into the mud in order to increase the likelihood that the cuttings will stay suspended in solution, or that the cuttings already falled out will be "picked up" by the fluid. Cuttings removal tools are used in the drill string. These tools usually have fixed blades and work while the drill string is rotating. Instead of continuing to drill, the driller may pick up the pipe (back it out) a certain distance while pumping fluid and rotating the pipe. This has the effect of cleaning the hole, but costs time (and therefore more money)

Thus, there is a need for a downhole tool design feature that enhances wellbore cleaning and reduction of cuttings beds without requiring additional hydraulic energy, specifically for ERD wells and other longer wellbore designs where hydraulic limits are routinely approached or breached. The present embodiments provide a hydraulic design that incorporates differential velocities across surfaces to increase turbulence in a predetermined manner, irrespective of the tool contained within it, which improves wellbore cleaning without moving parts or other hydraulic energy losses.

Embodiments are provided herein include tool designs to increase drilling efficiency and reduce MSE, especially in ERD projects. The present embodiments possess characteristics to both condition rough transitions and ledges in the dogleg curve and also to induce pressure waves designed to draw no-flow cuttings back up into the lateral flow path. Mechanical dogleg conditioning is improved by use of the present embodiments. Energy transferred through the drill string and to the bit in a well or set of wells where the dogleg is mechanically conditioned is also improved compared to a similar well or set of wells where this conditioning has not occurred. Overall the magnitude of torque fluctuations is reduced through the application of the present embodiments. Thus, an increase in drilling efficiency results.

It is now possible with the present embodiments to practically increase the length of laterals drilled and the efficiencies to be expected from these projects through the use and application of tools designed to reduce or eliminate borehole characteristics which commonly affect MSE. Tools designed to reduce MSE and increase efficiency will be used more often especially in ERD projects that require greater distances to be drilled in the laterals.

An important innovation of the present embodiments is the novel use of a fluid foil design which is drawn from and based upon air-foil technology. Oil-based and synthetic oil-based mud is often used in ERD and is a compressible fluid. Because of the compressible nature of these fluids, the high and low pressure responses seen in the interaction of relatively low density compressible air to air-foils are shown in the flow of the more dense compressible fluids while reacting to fluid-foils found in this tool in lateral and ERD projects.

Figure 6:
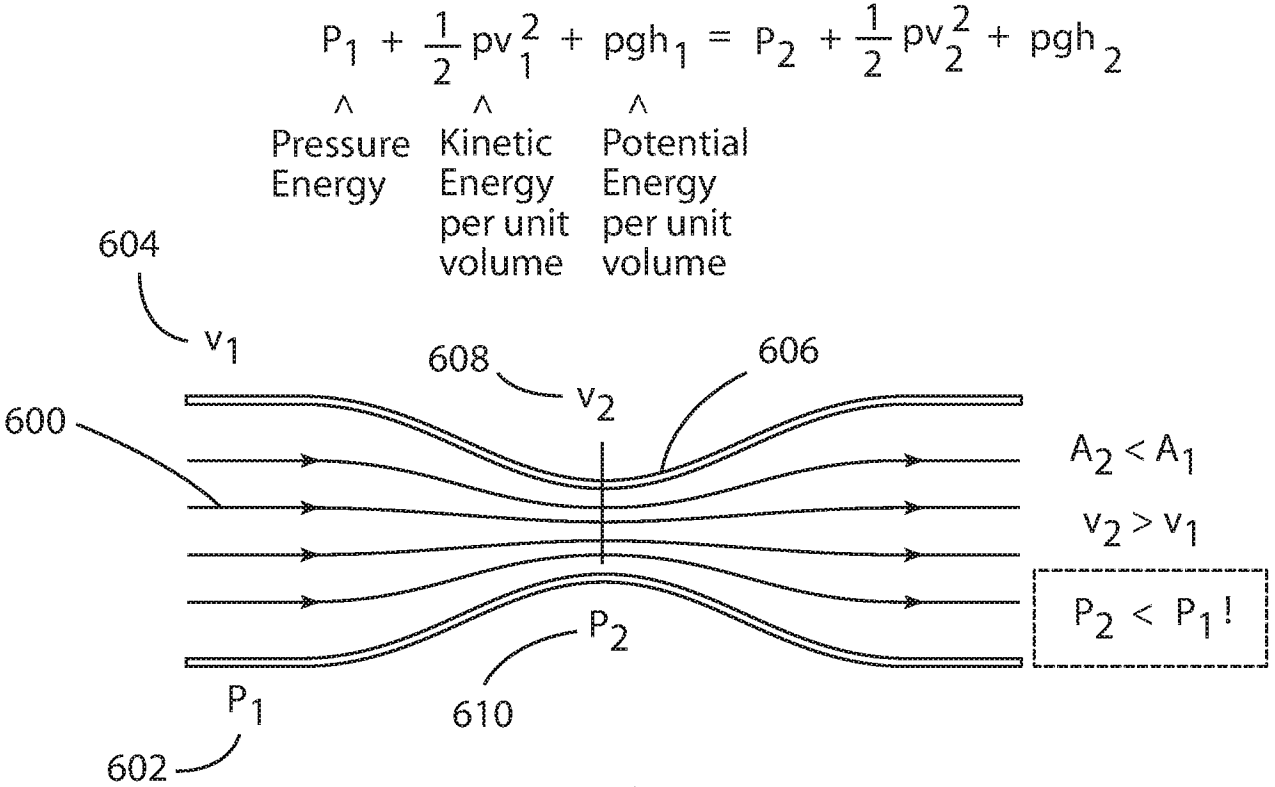
FIG. 6 illustrates a simplified schematic and formula showing how an airfoil creates "lift".
Figure 7:
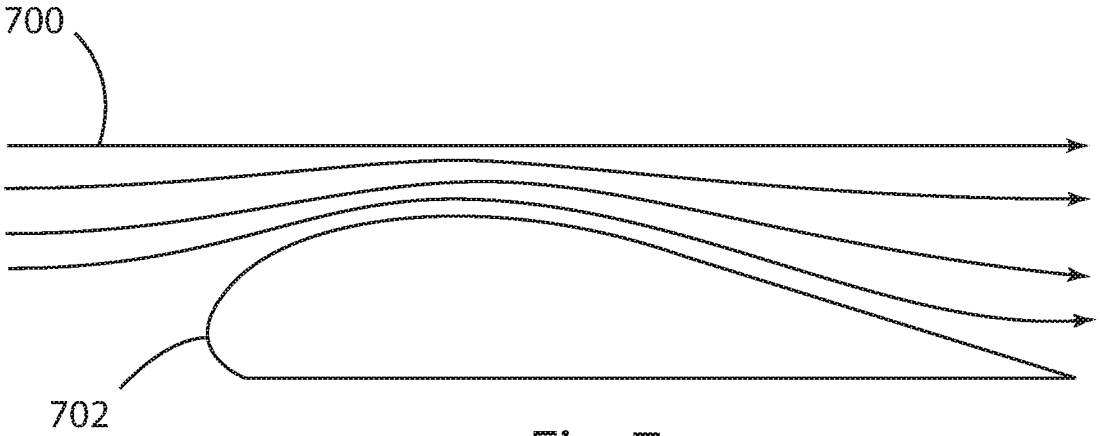
FIG. 7 illustrates a simplified schematic of a known airfoil.
Figure 8:
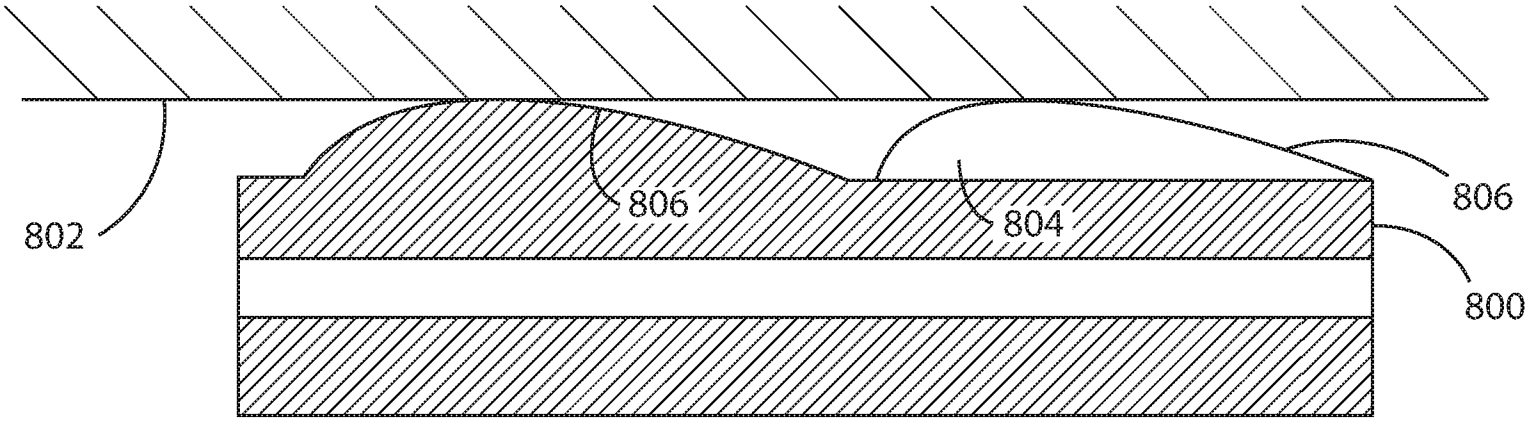
FIG. 8 illustrates a simplified schematic of an airfoil profile of the stabilizing blades of the exemplary embodiments.

The current embodiments can thus utilize an airfoil shaped tool configuration in various downhole assembly components environment to act as a cuttings removal tool even when the drill string is not in rotation since the effect is realized as fluid flows past it, such as if it is slid without rotation. The airfoil effect is shown in FIGS. 6-8, which shows a simple airfoil profile axially imposed upon the outside diameter (OD) of the tool body. An airfoil effect is known by the formula in FIG. 6 which mathematically expresses why and airfoil creates "lift". In the present instance this is described as fluid flow over an airfoil. As shown a fluid 600 at a first pressure 602 and a first velocity 604 reaches a constricted flow area 606 resulting in a second velocity 608 and second pressure 610. In the figure the hour glass shape shows how the Velocity (v), Cross-sectional area (A) and pressure (P) change as the geometry of the airfoil causes a difference in the cross sectional area. FIG. 7 shows a fluid 700 (such as air) flowing over an airfoil 702. A simplified schematic of the present embodiments is shown in FIG. 8 where a borehole assembly (BHA) 800 is disposed within a borehole wall 802, where BHA components 804 of the BHA are configured to have an airfoil shape 806.

In other words, the present embodiments employ the effect of differential velocities across surfaces of BHA components assembly such as the stabilizer, reamer and cuttings removal tools, alone or in any combination. These surfaces can also be integral to the shape of the sub housing or other drill string element and are designed such that they operate effectively within the confines of the tube-shaped annular area between the borehole wall and the nominal diameter of the drill string. Specific areas can be designed to both slow down and accelerate fluid in a controlled pattern to generate increased turbulence when fluid is pumped across the designed surface features or when the surfaces are pulled or pushed at sufficient axial displacement velocity for the differential pressure zones to be generated. The present embodiments stabilize the tool by engaging the borehole wall in a novel way using engagement pads that are offset both axially and circumferentially.

Figure 10:
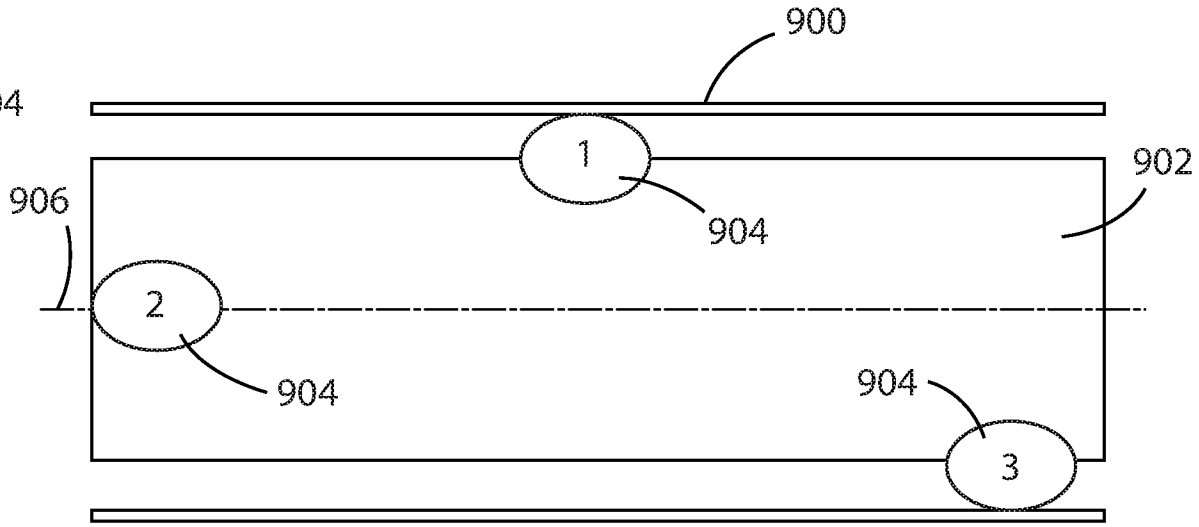
FIG. 10 illustrates a simplified sectional schematic of the stabilizing element positions on a side view of the exemplary embodiments taken along section lines X-X in FIG. 9.
Figure 9:
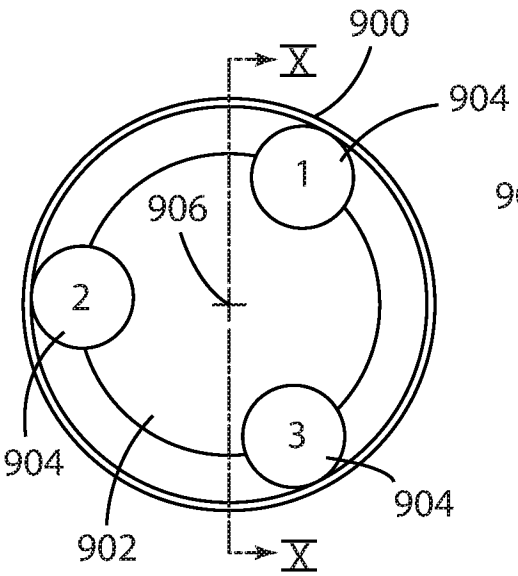
FIG. 9 illustrates a simplified schematic of the stabilizing elements positions on an end view of the exemplary embodiments.
Figure 12:
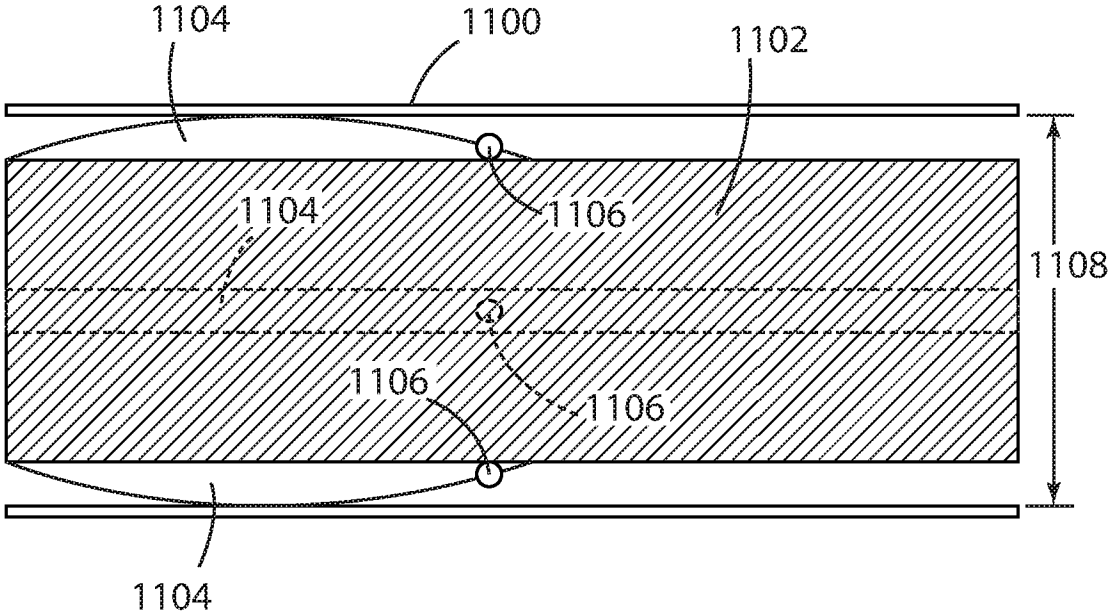
FIG. 12 illustrates a simplified sectional schematic of the stabilizing reamer element positions and cutting element positions on a side view of the exemplary embodiments taken along section lines XII-XII in FIG. 11.
Figure 11:
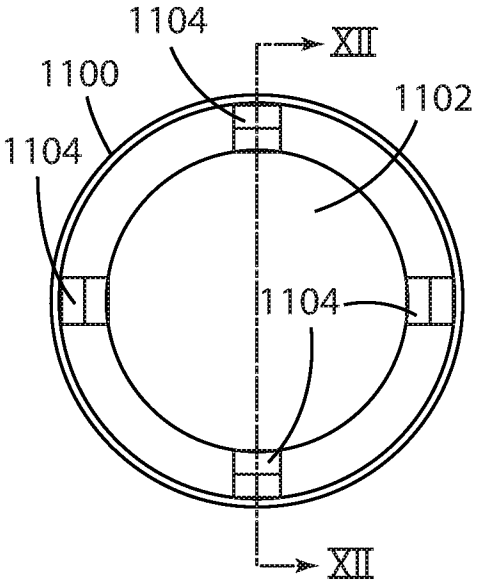
FIG. 11 illustrates a simplified schematic of the stabilizing reamer element positions and cutting element positions on an end view of the exemplary embodiments.

The diagrams as shown in FIGS. 9-11 show the end view and side view, where this offset is clear. FIGS. 9-10 shows a borehole assembly (BHA) 902 disposed within a borehole 900, having stabilizing elements 904. Here the BHA is stabilized in the center of borehole 900 about axis 906. FIG. 10 shows the axial offset of the stabilizer elements 904. FIGS. 11-12 shows a BHA 1102 disposed within a borehole 1100, having stabilizing/reamer blade elements 1104. The cutting element 1106 located below the borehole 1100 outside diameter 1108.

The current embodiments utilize the novel application of a cutting structure that, not under normal circumstances, engage the wall, and only engage the borehole wall when there are ledges that stick out beyond the normal OD of the wall and are then engaged by the cutting elements of the tool.

The present embodiments can be a combination tool. A key feature being the use of the shape of an airfoil in the axial machining profile of the tool. The application of the airfoil effect can be present in one approach in the shape/form of a stabilizer/reamer combination tool where the stabilizer blades are machined to the airfoil profile and the reamer section is undergage that it does not ream except for in the event that micro ledges or micro doglegs protrude from the wall and are then engaged or reamed smooth. As an example, the present embodiments can be directed to a stabilizer, reamer, cuttings removal tool that would be 'made-up' into the drill string. This particular example can act primarily as a stabilizer with reaming and cuttings removal elements.

Shown in FIG. 1 is one approach to the present embodiments showing a BHA component 20, which is shown as a combination stabilizer, reamer, and cuttings removal tool. Component 20 has a lower shank 24 and an upper shank 22. Component 20 also has a connection area having external threads 26 on the "pin" 28 end of the tool and is an exemplary means of fixing drill string components in a drill string or bottom hole assembly. The thread relief 32 is followed by lower shank 24. Lower shank 24 is a section of the tubular located outside of the area of the present component applications. Lower shank 24 is typically be used to 'make up' or attach the tool to the next piece of the drill string. This is where tongs (not shown) would 'grab' the tool to tighten it. Position 44 indicates a section of the tool where the profile has been machined in closer to the center axis of the tool. This would be close to the smaller/thinner/pointy side of the airfoil profile. The present tool of FIG. 1 also shows a trough/valley/"junk slot" 48. This portion of the tool is where the greatest flow occurs as it is normally the path of least resistance. The present tool of FIG. 1 also shows an undergauged cutting section 40. This cutting section 40 could utilize, PDC cutters, tungsten cutters, an abrasive coating or any other type of feature designed to cut, shear, crush, or erode portions of the borehole that protrude beyond typical OD as created by the drill bit. The present tool of FIG. 1 also shows shallow portion 42, which is the shallowest portion (meaning section most closely located toward the center of the tool.) of the airfoil profile as superimposed on the tool profile through a machining lathe operation. The present tool of FIG. 1 also shows blades 36 of the reamer component.

Figure 2:
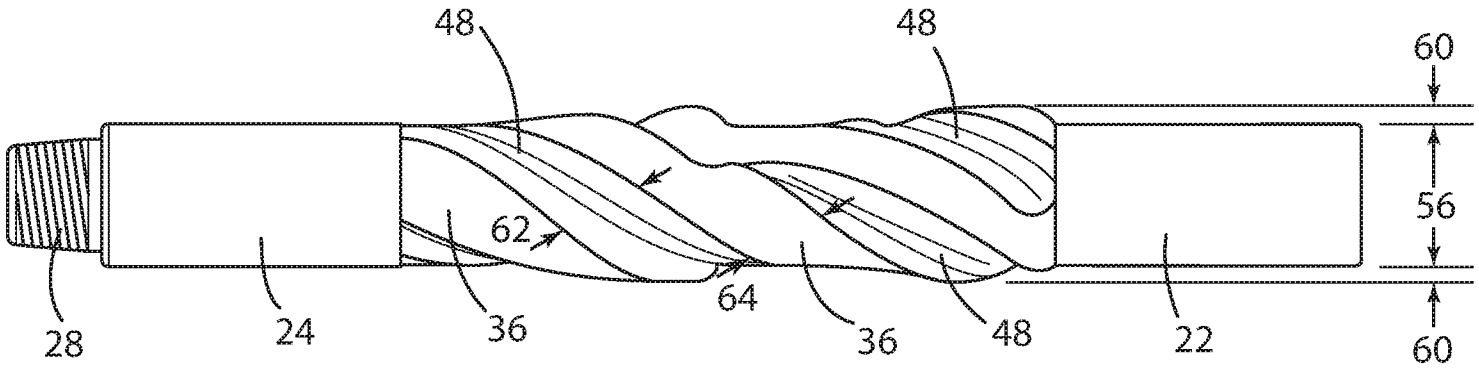
FIG. 2 illustrates a side view of the exemplary stabilizing tool of FIG. 1.
Figure 13:
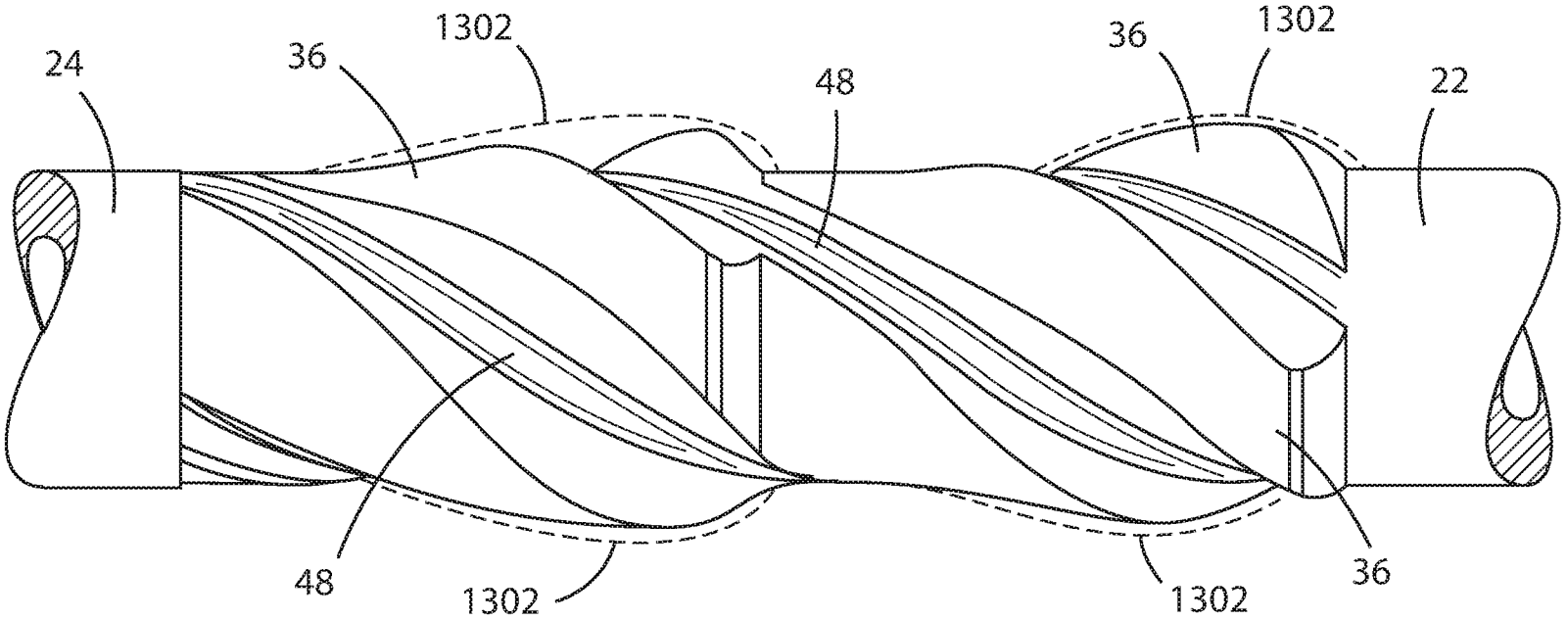
FIG. 13 illustrates the blade configuration profile of a stabilizer with a superimposed airfoil according to one approach of the present embodiments.
Figure 14:
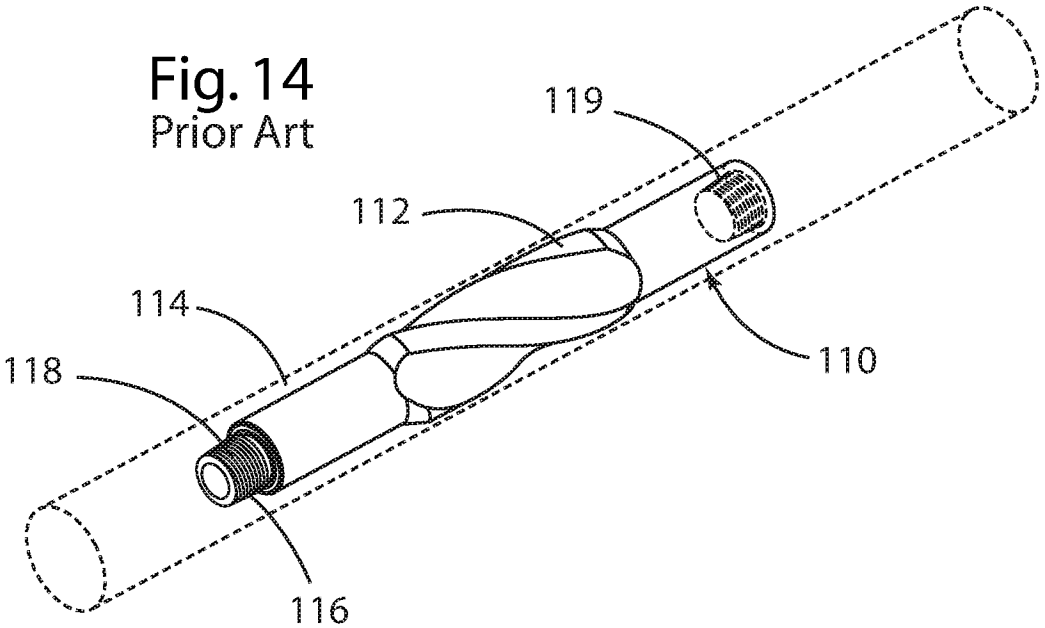
Fig. 14 Prior Art
FIG. 14 illustrates an exemplary PRIOR ART bladed stabilizer with a helix as it would look in a hole.
Figure 15:
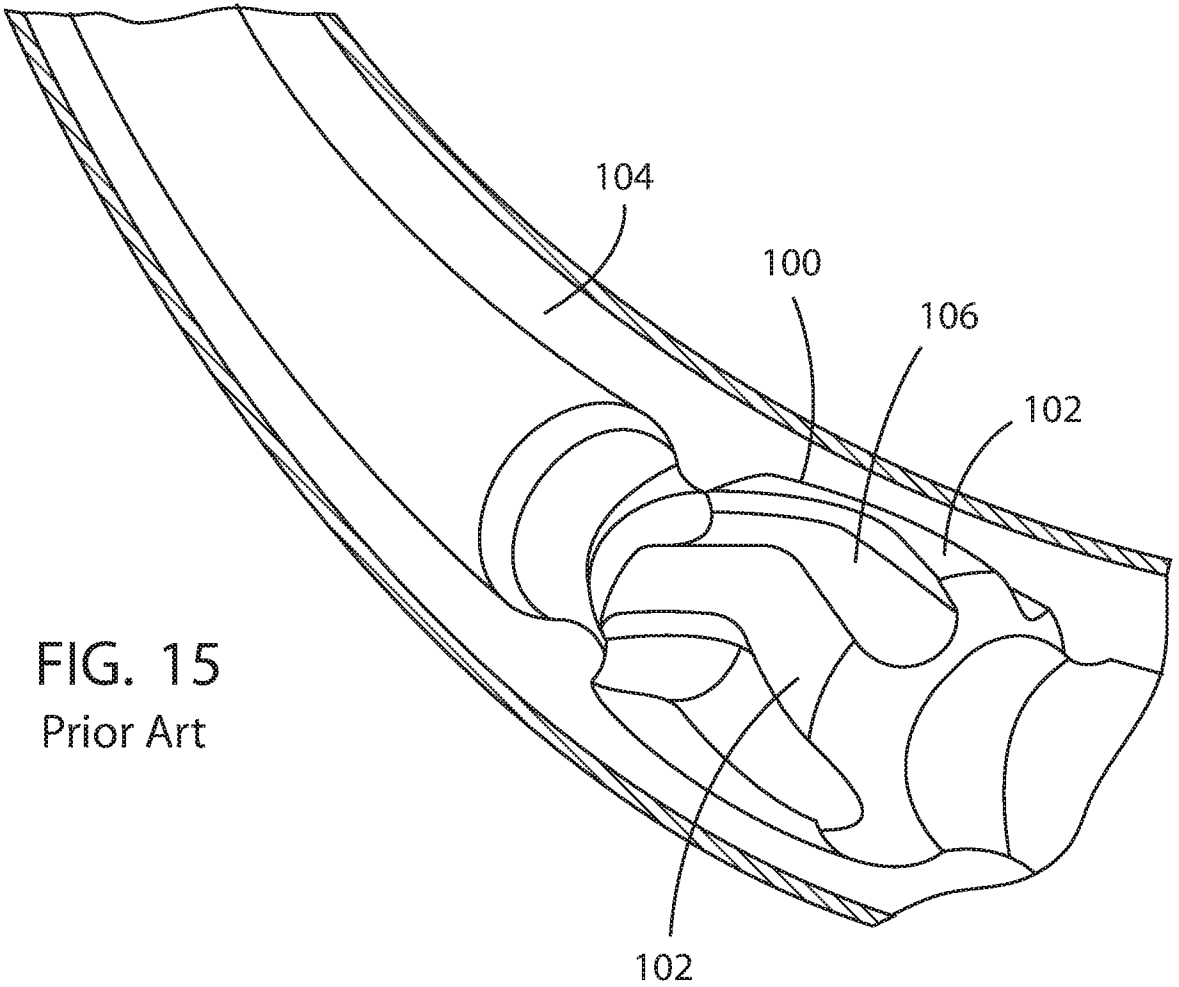
FIG. 15 Prior Art
FIG. 15 illustrates a cutaway view of an exemplary PRIOR ART cuttings removal tool.
Figure 16:
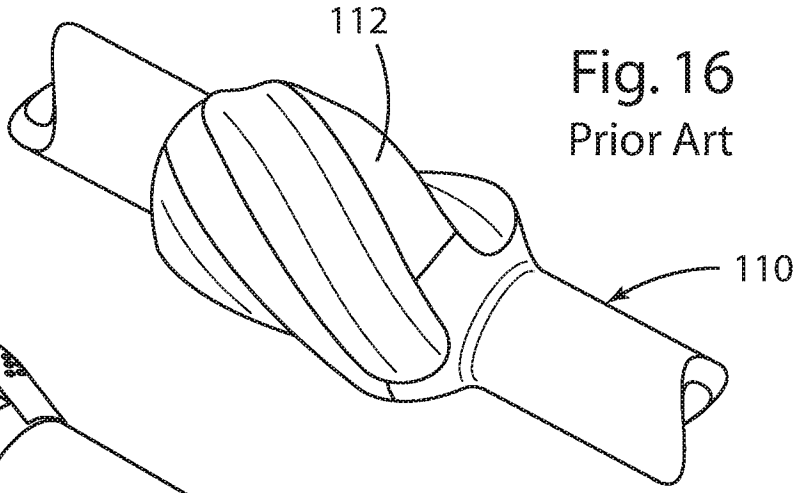
Fig. 16 Prior Art
FIG. 16 illustrates a PRIOR ART stabilizer tool.
Figure 17:
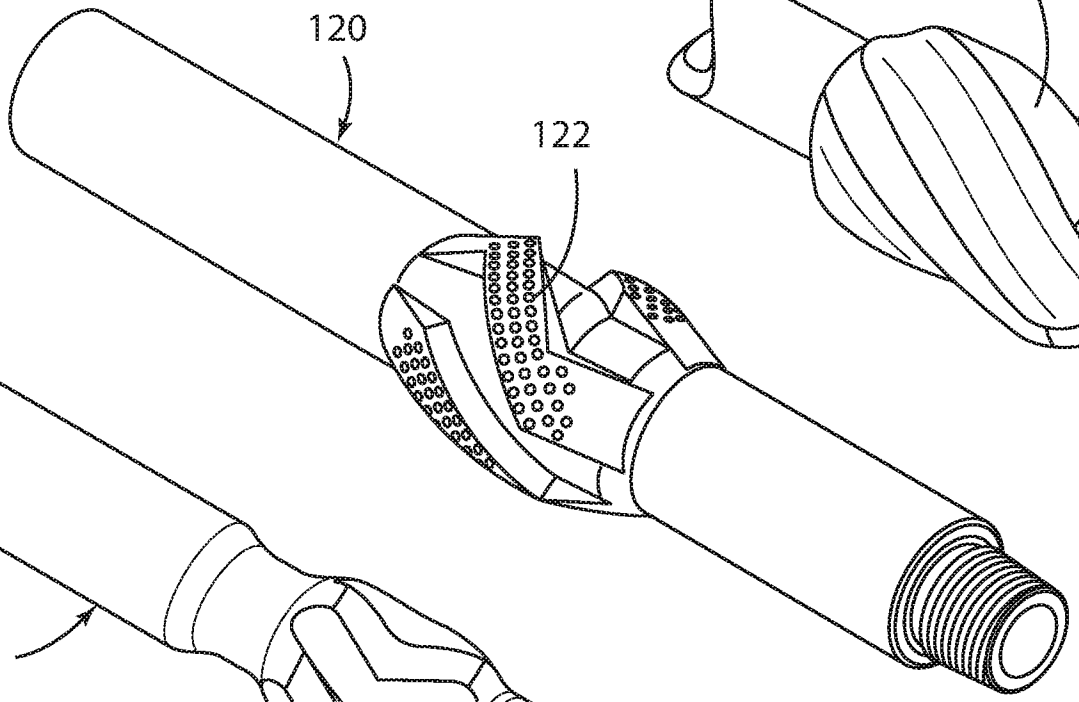
Fig. 17 Prior Art
FIG. 17 illustrates a PRIOR ART reamer tool.
Figure 18:
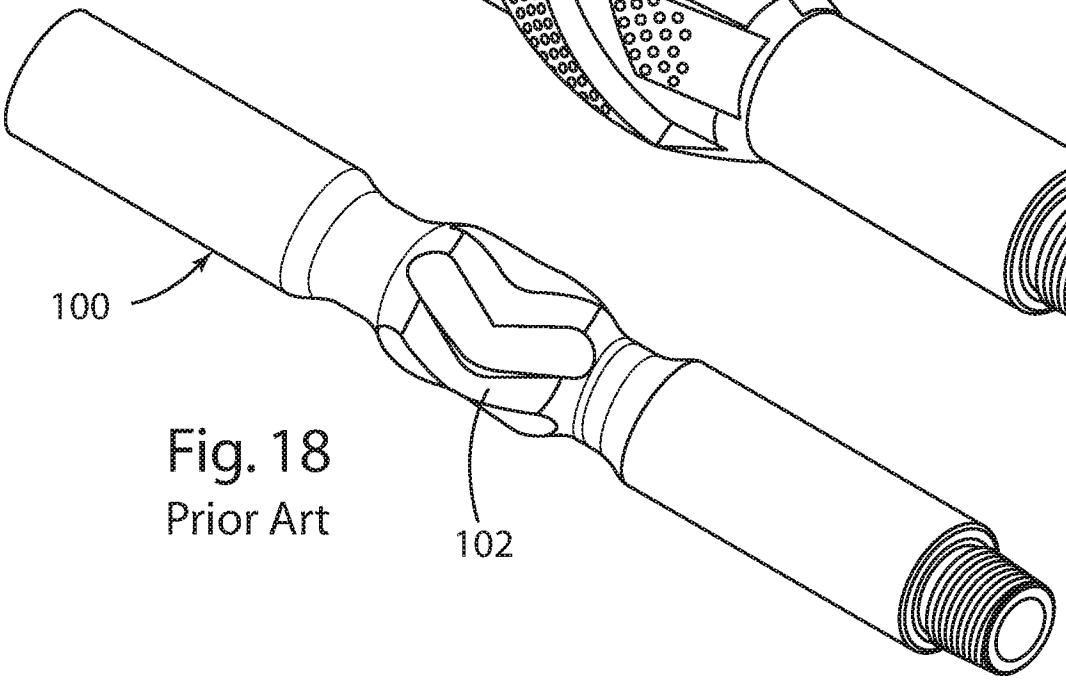
Fig. 18 Prior Art
FIG. 18 illustrates a PRIOR ART cuttings removal tool.

FIG. 2 shows a side view of the embodiment of FIG. 1. Diameter 56 is the OD of the tubular upon which the components have been machined, chemically, or mechanically affixed. Length 62 is the length from the edge of one blade 36 to the closest edge of the next blade 36. The distance and/or size can and will change depending upon the number of blades, degree of helix- or spiral, and size of the tool and/or borehole. Distance 64 is the distance at one point of the face of one of the blades 36. The length of distance 64 can change depending upon the number or blades, severity of helix or the blades, and or size of the tubular and or tool. Distance 60 is one half of the difference in OD of the tubular and the features of the air-foiled component. As shown in FIG. 13, the component is configured to follow the curve of a cambered airfoil, as shown at 1302.

Figure 3:
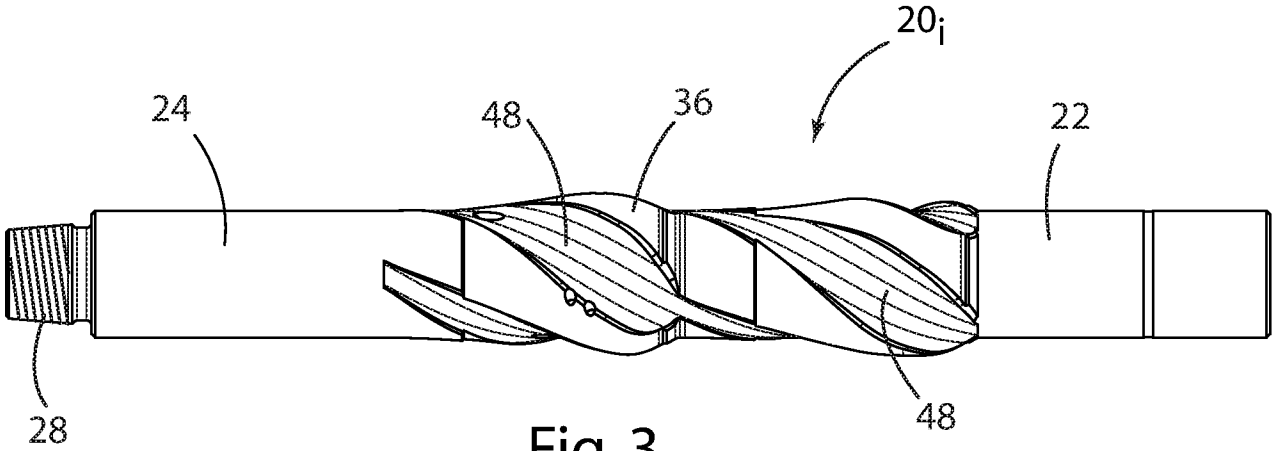
FIG. 3 illustrates a side view of the exemplary stabilizing tool according to another approach.
Figure 4:
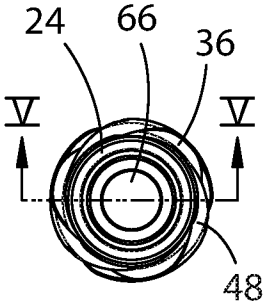
FIG. 4 illustrates an end view of the exemplary stabilizing tool of FIG. 3.
Figure 5:
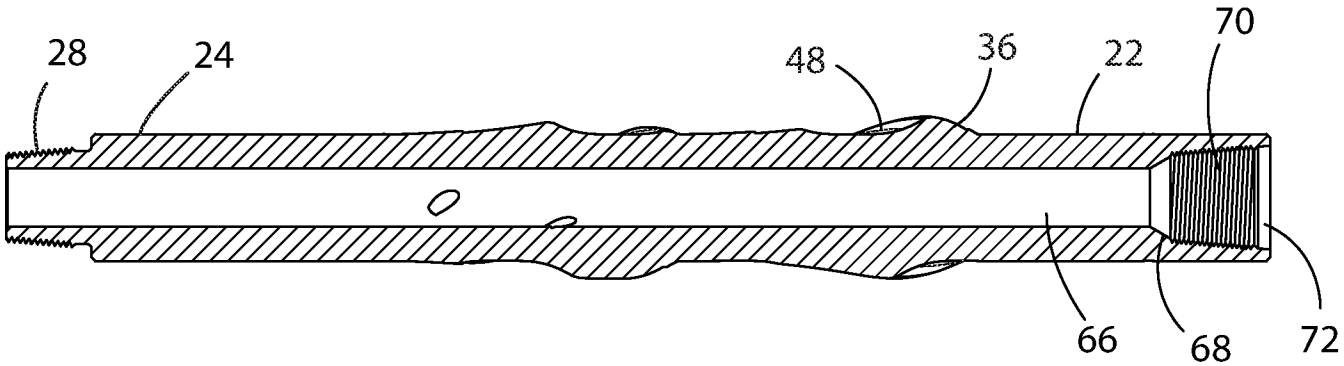
FIG. 5 illustrates a sectional side view of the exemplary stabilizing tool of FIG. 3 taken along section lines V-V in FIG. 4.

FIG. 3 is a side view of a tubular with the application of the features of the present embodiments according to another approach. FIG. 4 is a projected end view of FIG. 3. And, FIG. 5 is the section view of FIG. 3 as shown on FIG. 4. Portion 70 of FIG. 5 is an internal threaded section of the box portion of the tool to match external threads 28 in the drill string. Portion 68 provides thread relief leading to bore 66, which is its interior diameter (ID). Portion 72 is the box, or internal thread offset feature. This is not novel and is a typical way of fixing drill string components in a drill string or bottom hole assemble.

While the present embodiments have been disclosed in connection with the preferred embodiments shown and described in detail, various modifications and improvements thereon will become readily apparent to those skilled in the art.

What is claimed is:

1. A borehole tool, comprising: a cylindrical body, the cylindrical body having an upper shank, a lower shank, and a component tool disposed between the upper shank and the lower shank, wherein the component tool is configured to have an outer surface airfoil configuration, whereby lift is created as fluid passes along the cylindrical body;

wherein the airfoil configuration changes in annular volume within the cylindrical body such that fluid moving across said tubular surface enters an annular cross sectional area that is reduced in an axial direction at a predetermined rate, and wherein orientation of the reduced cross section functions with fluid movement towards the surface of a wellbore.

2. The borehole tool of claim 1, wherein the component tool is selected from the group consisting of a stabilizer tool, a reamer tool and a cutting removal tool.

3. The borehole tool of claim 2, wherein the component tool is a combination stabilizer tool, a reamer tool and a cutting removal tool, wherein the stabilizer tool is configured as a helical stabilizing blade and reamer blade, a flow path disposed between the helices of the stabilizing and reamer blade, the stabilizing and reamer blade further comprising a reamer cutting element disposed where an edge of the stabilizing and reamer blade meets the flow path.

4. The borehole tool of claim 1, wherein the airfoil is configured to create lift as fluid passes along the cylindrical body in either direction, whereby differing fluid velocities are generated irrespective of fluid motion being upwards, towards a surface or down, towards an end of a wellbore of a drill string axis.

5. A borehole tool, comprising: a cylindrical body, the cylindrical body having an upper shank, a lower shank, and a component tool disposed between the upper shank and the lower shank, wherein the component tool is configured to have an outer surface airfoil configuration, whereby lift is created as fluid passes along the cylindrical body, wherein the airfoil configuration changes in annular volume within the cylindrical body such that fluid moving across said tubular surface enters an annular cross sectional area that is reduced in an axial direction at a predetermined rate, and wherein orientation of the reduced cross section functions with fluid movement towards the bottom of a wellbore.

6. The borehole tool of claim 1, wherein the borehole tool is disposed within a tool selected from the group consisting of a drill collar, downhole motor housing, measurement while drilling tool housing, logging while drilling tool housing, hole opener, under-reamer, earth removal tool body, crossover sub, pulsing sub, dampening sub, drilling jars, downhole tool body and combinations thereof, stabilizer tool, hole-conditioning tool, drill pipe tubulars.

7. The borehole tool of claim 5, wherein the component tool is selected from the group consisting of a stabilizer tool, a reamer tool and a cutting removal tool.

8. The borehole tool of claim 5, wherein the component tool is a combination stabilizer tool, a reamer tool and a cutting removal tool, wherein the stabilizer tool is configured as a helical stabilizing blade and reamer blade, a flow path disposed between the helices of the stabilizing and reamer blade, the stabilizing and reamer blade further comprising a reamer cutting element disposed where an edge of the stabilizing and reamer blade meets the flow path.

* * * * *